US006133842A

United States Patent [19]

Gariepy

[11] Patent Number: 6,133,842

[45] Date of Patent: Oct. 17, 2000

[54] ALARM SYSTEM FOR PORTABLE CONTAINER

[76] Inventor: Jason Gariepy, 270 Handy St., Attleboro, Mass. 02703

[21] Appl. No.: 09/440,184

[22] Filed: Nov. 15, 1999

[51] Int. Cl.[7] ..... G08B 21/00

[52] U.S. Cl. ..... 340/689; 340/545.1; 340/586; 340/686.1

[58] Field of Search ..... 340/689, 686.1, 340/585, 586, 571, 545.1, 574

[56] References Cited

U.S. PATENT DOCUMENTS

| | | | |
|---|---|---|---|
| 4,591,835 | 5/1986 | Sharp | 340/574 |
| 4,841,285 | 6/1989 | Laut | 340/571 |
| 5,027,105 | 6/1991 | Dailey et al. | 340/571 |
| 5,148,150 | 9/1992 | White et al. | 340/571 |
| 5,153,561 | 10/1992 | Johnson | 340/571 |
| 5,270,686 | 12/1993 | Martinez | 340/689 |
| 5,847,647 | 12/1998 | Devine | 340/571 |
| 5,877,686 | 3/1999 | Ibey et al. | 340/571 |

*Primary Examiner*—Jeffery A. Hofsass
*Assistant Examiner*—Phung Nguyen

[57] ABSTRACT

This invention relates to a programmable alarm system designed for an airtight container such as a cooler or the like. More specifically, the alarm system includes embedded motion and tilt responsive devices that are actuated upon movement of the container or opening of the container cover. The alarm computer and associated motion and tilt responsive devices are embedded within the (container to prevent potential deactivation of the alarm by unauthorized parties as well as to preserve the sealed integrity of the container.

8 Claims, 3 Drawing Sheets

ALARM SYSTEM FOR PORTABLE CONTAINER

BACKGROUND OF THE INVENTION (1) Field of the Invention

This invention relates to a programmable alarm system designed for an airtight container such as a cooler or the like. More specifically, the alarm system is located internally to the container and is activated upon movement of the container or opening of the container cover.

(2) Description of the Prior Art

Heretofore, various arrangements have been disclosed for providing audible alarm means for detecting unauthorized openings of containers, see for example Tucci, U.S. Pat. No. 4,052,718. Tucci discloses a rudimentary alarm system, which is externally adapted to a container. The Tucci alarm system fails in its application to the specific requirements of an alarm for an airtight container since it utilizes external pressure sensitive switches which impede the sealed integrity of the container being alarmed. Furthermore, the Tucci alarm is visible to potential thieves giving them the opportunity for attempted deactivation of the alarm prior to intrusion into the enclosure. A patent by Streeter, U.S. Pat. No. 5,574,429 relates to a portable, self contained alarm system which would be attached to an article to monitor the movement of the article, and sound an alarm signal under certain conditions such as the unauthorized movement of the article. This patent differs significantly from the disclosed invention since it does not contain provisions to be mounted internal to a container. A prior patent to Johnson, U.S. Pat. No. 5,153,561 relates to a locked security box and, in particular, to a portable security box suitable for use by beach goers. The Johnson invention utilizes a latch locking means to detect opening of the cover and motion detection means. The invention is powered by a solar cell and contains discrete electronic circuits which sequentially perform the functions of arming, disarming, and resetting. The invention disclosed herein utilizes motion detection means as well as tilt responsive devices mounted internal to the hinge of the container being alarmed. The disclosed invention also utilizes a rechargeable battery power supply which is appropriate for use during the day or night. The Johnson alarm is continuously powered by a solar cell which is appropriate only for its intended daytime beach use. It would be inappropriate for an anti-theft device used at night. The invention of the current disclosure further differs from the Johnson patent because it uses a programmable microcontroller as a means to dynamically change operating characteristics and is not limited to a singular method of operation. It is a common scenario for portable coolers to be stolen from campsites and picnic areas. Other concerns include access by minors to coolers stocked with alcoholic beverages. In certain parts of the country bears nave been noted to target coolers for food. In these situations a programmable alarmed cooler would have prevented theft or unauthorized access.

SUMMARY OF THE INVENTION

A self contained, programmable alarm system for a portable container is disclosed. One embodiment of the alarm system is comprised of an alarm system controller, alarm signaling device, a power source, and keypad entry means all embedded within a container such as a cooler. The controller unit runs the operating program of the alarm system. The operating program determines the operation of the alarm system. The program allows the user to program parameters such as arming, disarming and password setting.

Arming modes are allowed which give the user a delay prior to alarm signaling to provide the user time to move or open the container. The programmable alarm system of the present invention utilizes embedded motion and tilt responsive devices to detect unauthorized entry into the container being alarmed. For an application such as a portable cooler embedded tilt responsive devices preserve the sealed integrity of the cooler far better than pressure responsive switches mounted on the rim of a cooler. It is therefore necessary to provide tilt responsive devices mounted in the cooler cover. Furthermore, placement of motion sensors and tilt responsive devices within a container eliminate the possibility of deactivation of the alarm by unauthorized parties.

Accordingly, it is an object of the present invention to provide an improved container alarm system.

It is a further object of the present invention to provide a container alarm system which maintains the integrity of airtight containers such as coolers.

It is a further object of the present invention to provide a container alarm system which is embedded in the container being alarmed for the purpose of preventing intruder deactivation.

It is a further object of the present invention to provide an alarm system which is actuated by both unauthorized entry and movement of the container and which aids in deterring the commission of a crime.

It is still a further object of the present invention to provide an alarm system which is programmable and user friendly.

Other objects, aspects and advantages of the present invention will be apparent when the detailed description is considered with the accompanying drawings.

DESCRIPTION OF PREFERRED EMBODIMENT

Figure 1:
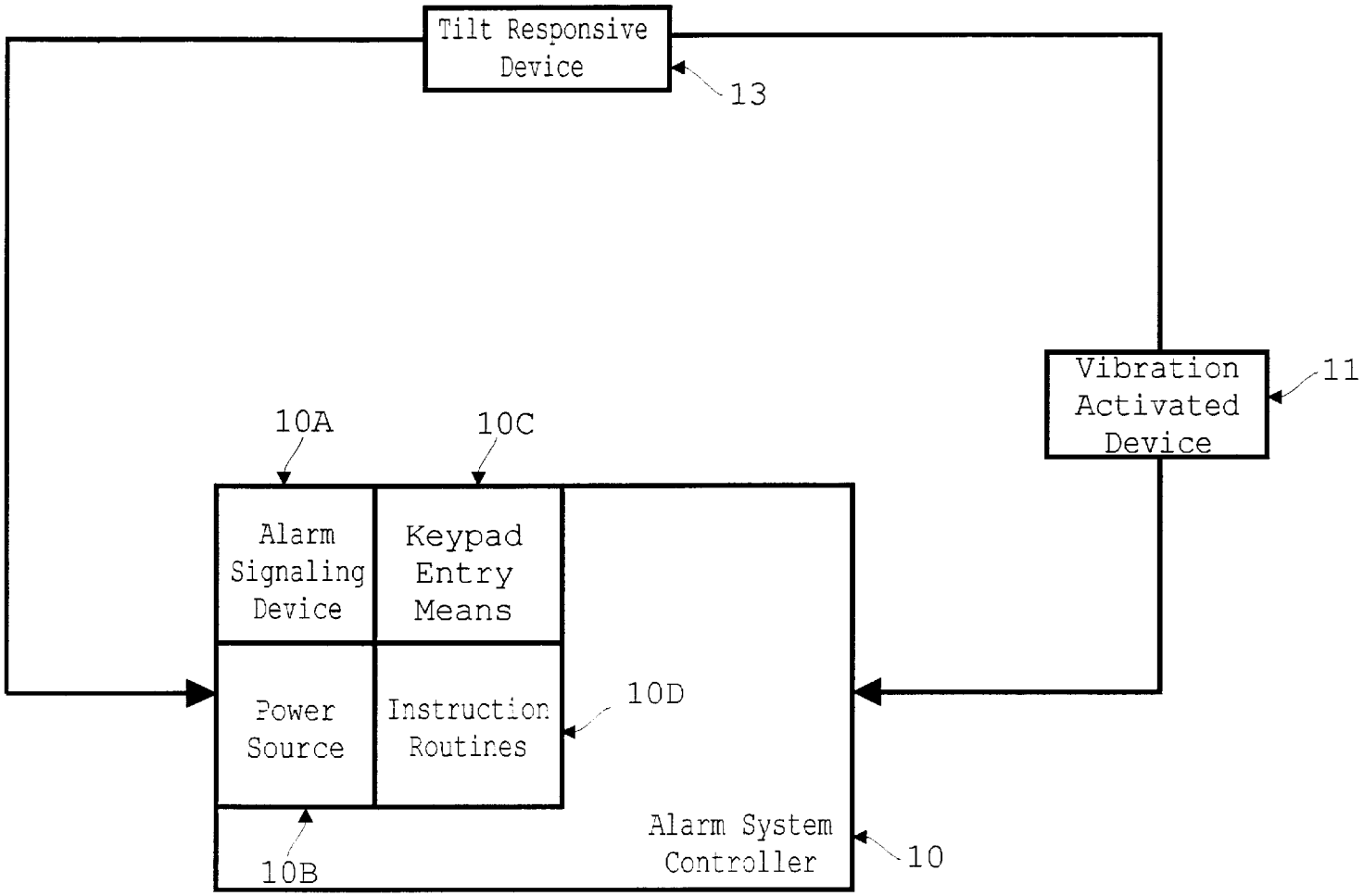
FIG. 1 is a schematic representation of the alarm circuit of the present invention.
Figure 2:
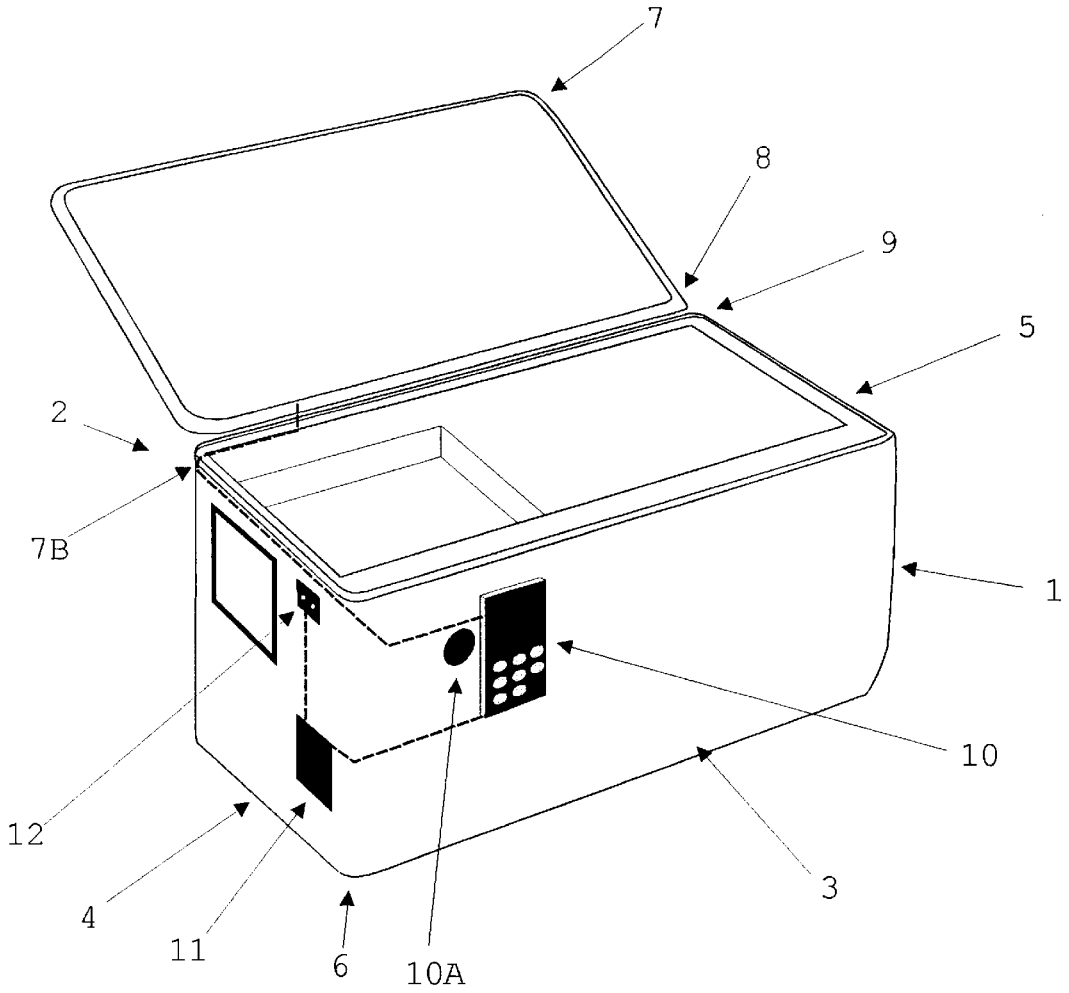
FIG. 2 is a representation of the subject invention as applied to a portable cooler.
Figure 3:
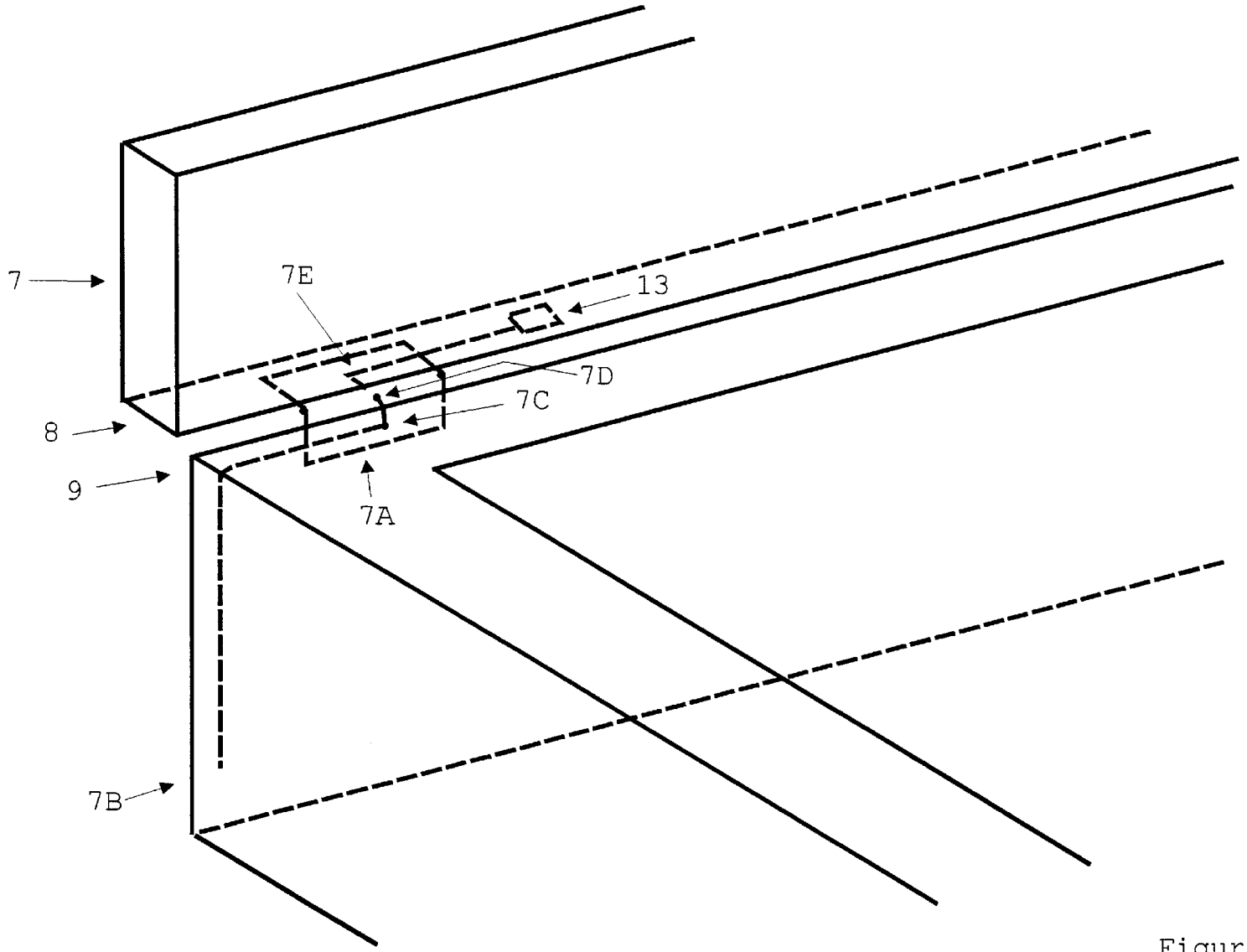
FIG. 3 is a view of the wiring of the tilt responsive device through the portable cooler hinge.

Referring to FIG. 2 the secured container of the invention comprises a portable cooler 1 having longitudinal side walls 2 and 3, opposite end walls 4 and 5, and a bottom wall 6 which are permanently secured and scaled together, preferably with integral construction. The cooler 1 has a lid, or top cover 7 which is hinged along one longitudinal side edge 8 to a longitudinal side edge 9 of the cooler 1. A programmable alarm system controller 10 is embedded with n longitudinal sidewall 3. Referring to FIG. 1, keypad entry means 10C is located within controller 10 and is exposed for user access. In the preferred embodiment, an alarm signaling device 10A, power source 10B, and instruction routines 10D are all located within controller 10. The power source is a battery type with the capability to be recharged. The controller contains an indication LED which illuminates upon the battery level being low. Upon battery low indication Outlet 12 of FIG. 2 can be externally accessed to provide battery recharging. In the preferred embodiment, outlet 12 is a Switchcraft EN3 weathertight connector or its equivalent. One or more vibration activated devices 11 are located within the sidewalls of the container and are activated by any motion of the container. In the preferred embodiment one vibration activated device 11 is embedded within the front longitudinal sidewall 3 as shown in FIG. 2. The first condition of the vibration activated devices is when they are electrically open and at rest. A second condition occurs when the container is moved or vibrated and a pulse is outputted to the controller 10. The controller unit evaluates this pulse by sensing the transition between the first and second conditions and sounds an alarm if the user programmed alarm criteria is met. One or more tilt responsive devices 13 are cooperatively adapted within the cover 7. The longitudinal side edge 8 of cover 7 is connected to the longitudinal side edge 9 of cooler 1 by a hinge 7A. Wire 7B electrically connects controller 10 to tilt responsive device 13. Wire 7B is embedded within the sidewalls of cooler 1 and exits through side edge 9 through an opening at point 7C. The wire is exposed and enters the hinge 7A through an opening in the hinge at point 7D. The hinge 7A has sufficient thickness such that the wire is not exposed as it passes through hinge 7A and exits through an opening 7E in longitudinal side edge 8 of cover 7. The wire is then connected to tilt responsive device 13 which is securely fastened to cover 7 by adhesive. A tilt responsive device suitable for use or its equivalent is available as part # CW 1300-1 (motion switches-metal) from the Comus Group of Companies. In the preferred embodiment only one tilt responsive device is utilized. The first condition of the tilt responsive device is when the container cover is closed and the device is electrically open. A second condition occurs when the cover is open and a pulse is outputted to the controller. The controller evaluates this pulse by sensing the transition between the first and second conditions and sounds an alarm if the user programmed alarm criteria is met. The controller unit runs the operating program for the alarm system, In the preferred embodiment a digital microcontroller or its equivalent is utilized. However, it should be realized that any digital/analog circuitry can be utilized to perform the intended functions. In the preferred embodiment the alarm system has three modes or instruction routine. By entering M at the keyboard entry means the controller is then ready to accept an alarm mode. Mode 1 is when the alarm system is off and is entered as 1 at the keypad. Mode 2 is initiated by entering 2 at the keypad entry means. The alarm controller becomes electrically connected to the power source and the controller initializes by performing instruction routines of the operating program. Mode 2 initiates an instant arming routine and a chime alarm will sound if the container is moved or vibrated or if the container cover is lifted. Mode 3 is initiated by entering 3 at the keypad entry means. The alarm controller becomes electrically connected to the power source and the controller initializes by performing instruction routines of the operating program. Mode 3 initiates a delayed arming routine and a ten second delay will occur prior to a siren type alarm sounding if the container is moved, vibrated, or the cover is lifted. Subsequent to entering an alarm mode a user notification routine executes and the controller outputs an audible beep tone and illuminates an LED to inform the user that the alarm system has been activated. A password mode initiates a password setting routine and a user-defined code can be entered at the keyboard which defines an operators access code. This code can be changed and allows only authorized individuals the ability to set the alarm, This same password is entered at the keyboard to disarm the alarm system when the alarm is sounding. By entering this password a disarming routine executes and terminates the sounding of the alarm.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, as set forth in the following claims:

What is claimed is:

1. An alarmed portable container comprising:

a closed receptacle having an interior chamber, said closed receptacle having a front longitudinal side wall;

a rear longitudinal side wall, a left end wall, a right end wall, and a bottom wall which are permanently secured together;

a top cover hinged to said rear longitudinal side wall moveable between an open position and a closed position;

an alarm signaling device contained within said front longitudinal side wall;

a power source contained within said front longitudinal side wall;

a programmable alarm system controller contained within said front longitudinal side wall and electrically connected to said alarm signaling device and said power source:

Keypad entry means contained within said front longitudinal side wall and exposed to view and free access, said entry means electrically connected to said programmable alarm system controller;

one or more vibration detection device(s) mounted in one or more preselected positions within said receptacle and being electrically connected to said programmable alarm system controller, each of said vibration detecting device(s) being operable, in response to movement of said receptacle, between a first condition and a second condition whereby said alarm signaling device is activated;

one or more tilt responsive device(s) cooperatively mounted within said top cover, wherein said cooperatively mounted tilt responsive device (13) is electrically connected to said controller by a wire (7B), wherein said wire (7B) exits through said side edge (9) through an opening (7C) in said side edge (9) then enters said hinge (7A) through opening (7D) wherein said wire (7B) then passes within hinge (7A) an exits through an opening (7E) of said side edge (8) wherein said wire (7B) passes within said cover (7) said wire 7(B) being electrically connected to said tilt responsive device (13), each of said tilt responsive device(s) being operable in response to opening of said top cover, between a first condition and a second condition whereby said alarm signaling device is activated;

wherein said programmable alarm system controller detects movement of said receptacle by sensing transitions between said first and second conditions of said vibration detecting devices;

wherein said programmable alarm system controller detects opening of said top cover by sensing transitions between said first and second conditions of said tilt responsive devices;

wherein said controller contains an operating program which determines the operation of said alarm system;

wherein said operation of said alarm system begins when said keypad entry means electrically connects said power source to said controller and said controller initializes and performs instruction routines of said operating program;

wherein said operating program includes a plurality of said instruction routines, each of which can be executed and varied, wherein selected said instruction routines determine selected characteristics of operation of said alarm system.

2. An alarm system as in claim 1 wherein said programmable controller is a microcontroller.

3. An alarm system as in claim 1 wherein said power source is a battery.

4. An alarm system as in claim 3 wherein said power source is rechargeable.

5. An alarm system as in claim 1 wherein said one or more vibration detecting device(s) are motion detectors.

6. An alarm system as in claim 1 wherein said one or more tilt responsive device(s) are non-mercury tilt switches.

7. An alarm system as in claim 1 wherein said alarm signaling device is a piezo-electric alarm device.

8. An alarm system as in claim 1 wherein said routines include an instant arming routine whereby said alarm system becomes armed immediately after said alarm system activation, such that said alarm system controller begins monitoring of said first and second condition of said vibration detection devices and said tilt responsive devices;

a delayed arming routine whereby said alarm system delays arming after said alarm system activation, such that after a period of delay said alarm system controller begins monitoring of said first and second condition of said vibration detection device(s) and said tilt responsive devices;

a user notification routine whereby said alarm system controller outputs audible and visual information alerting the user that said alarm system is armed;

A password setting routine whereby user defined passwords can be programmed to allow only authorized access for arming and disarming of said alarm system;

An instant disarming routine whereby said alarm system becomes disarmed such that said alarm system controller terminates monitoring of said first and second condition of said vibration detecting devices and said tilt responsive devices.

* * * * *